US009085380B2

(12) United States Patent
Monti

(10) Patent No.: US 9,085,380 B2
(45) Date of Patent: Jul. 21, 2015

(54) APPARATUS FOR FILLING CONTAINERS WITH PHARMACEUTICAL/PARAPHARMACEUTICAL ARTICLES

(71) Applicant: Marchesini Group S.p.A., Pianoro (Bologna) (IT)

(72) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 308 days.

(21) Appl. No.: 13/864,374

(22) Filed: Apr. 17, 2013

(65) Prior Publication Data

US 2013/0269831 A1 Oct. 17, 2013

(30) Foreign Application Priority Data

Apr. 17, 2012 (IT) ..... BO2012A0209

(51) Int. Cl.

| | |
|---|---|
| ***B65B 1/08*** | (2006.01) |
| ***B65B 1/30*** | (2006.01) |
| ***B65B 39/00*** | (2006.01) |
| ***B65B 57/14*** | (2006.01) |
| ***B65B 57/20*** | (2006.01) |
| ***B65B 5/10*** | (2006.01) |

(52) U.S. Cl.

CPC ... *B65B 1/08* (2013.01); *B65B 1/30* (2013.01); *B65B 5/103* (2013.01); *B65B 39/00* (2013.01); *B65B 57/14* (2013.01); *B65B 57/20* (2013.01)

(58) Field of Classification Search

CPC ..... B65B 1/08; B65B 1/30; B65B 5/103; B65B 57/14; B65B 57/20

USPC ..... 141/11, 69, 71, 94

See application file for complete search history.

(56) References Cited

U.S. PATENT DOCUMENTS

| | | | | |
|---|---|---|---|---|
| 6,561,377 | B1 * | 5/2003 | Pearson et al. | 221/7 |
| 7,107,741 | B2 | 9/2006 | Monti | |
| 7,134,460 | B2 * | 11/2006 | Kaplan et al. | 141/200 |
| 7,395,841 | B2 * | 7/2008 | Geltser et al. | 141/2 |

(Continued)

FOREIGN PATENT DOCUMENTS

| | | |
|---|---|---|
| WO | WO96/04171 A | 2/1996 |

OTHER PUBLICATIONS

European Search Report for corresponding EP application No. EP 13 16 3269, dated Jun. 24, 2013, 4 pages.

*Primary Examiner* — Nicolas A Arnett

(74) *Attorney, Agent, or Firm* — Francis J. Maguire; Ware Fressola Maguire & Barber LLP

(57) ABSTRACT

An apparatus for filling containers with pharmaceutical articles comprises a transfer element (1) arranged to receive articles from a conveyor (V) and to transfer them to a mouth (I) of an article accumulating conduit (C) positioned above a container. A sensor (8, 9) detects article characteristics and counts the articles. A mobile element (2) has a first curved surface (21) and a second curved surface (22), the element being movable between a first orientation (P1), in which the first curved surface enables an advancement of articles detected as being whole towards the mouth (I) of the accumulating conduit (C), and a second orientation (P2), with the second curved surface (22) arranged to prevent a continuity of advancement for the articles detected as not being whole, diverting these away from the mouth of the accumulating conduit (C).

12 Claims, 4 Drawing Sheets

(56) References Cited

U.S. PATENT DOCUMENTS

| | | | | |
|---|---|---|---|---|
| 7,631,670 | B2 * | 12/2009 | Geltser et al. | 141/1 |
| 7,956,623 | B2 * | 6/2011 | Bassani et al. | 324/663 |
| 8,020,724 | B2 * | 9/2011 | Remis et al. | 221/211 |
| 8,102,170 | B2 * | 1/2012 | Monti | 324/71.4 |
| 8,121,392 | B2 * | 2/2012 | Popovich et al. | 382/143 |
| 8,917,100 | B2 * | 12/2014 | Monti | 324/671 |
| 2004/0007442 | A1 * | 1/2004 | Monti | 198/538 |
| 2006/0076077 | A1 * | 4/2006 | Kaplan et al. | 141/83 |
| 2009/0056825 | A1 | 3/2009 | Mertens et al. | |
| 2009/0094947 | A1 * | 4/2009 | Aylward | 53/501 |
| 2009/0255948 | A1 | 10/2009 | Bassani | |
| 2011/0113730 | A1 * | 5/2011 | Aylward | 53/432 |
| 2012/0160370 | A1 * | 6/2012 | Kobayashi et al. | 141/331 |
| 2012/0216487 | A1 * | 8/2012 | Henkel | 53/167 |
| 2012/0305133 | A1 * | 12/2012 | Ansaloni et al. | 141/180 |
| 2013/0081737 | A1 * | 4/2013 | Bassani | 141/283 |
| 2013/0092592 | A1 * | 4/2013 | Singer | 206/528 |
| 2013/0134071 | A1 * | 5/2013 | Singer | 209/3.2 |
| 2013/0271162 | A1 * | 10/2013 | Monti | 324/671 |
| 2014/0261881 | A1 * | 9/2014 | Chudy | 141/94 |

* cited by examiner

APPARATUS FOR FILLING CONTAINERS WITH PHARMACEUTICAL/PARAPHARMACEUTICAL ARTICLES

FIELD OF THE INVENTION

The present Invention relates to the technical sector concerning filling containers, such as for example bottles, with pharmaceutical/parapharmaceutical articles such as for example pills, tablets, capsules, etc.

DESCRIPTION OF THE PRIOR ART

In this specific sector when discrete articles of a pharmaceutical/parapharmaceutical type are to be packed, such as for example, as mentioned above, pills, tablets, capsules etc., in a container, such as for example a bottle, it is necessary to carry out the counting of the articles which are directed into the inside of the container.

In fact, it is of fundamental importance that internally of each container destined for sale to the public, that there should be available the exact number of articles required.

Further, it is also of fundamental importance to be able to determine, before each article is directed into the container, whether this article is perfectly whole or not.

It is necessary to prevent not-perfectly-whole articles, i.e. articles that are partly damaged or grazed, or articles that do not correspond to required standards, from entering Into commercial situations.

The possibility of carrying out this control, i.e. an operation that controls, or validates, the integrity of the article before it is placed internally of a relative container, can enable carrying out a discriminatory selection, i.e. can distinguish whether an article is suitable or not, i.e. whole or not whole, to be placed on the market.

For the above purposes and requirements (counting the articles placed in a container, evaluating the integrity of the articles directed towards the containers with a validation of the integrity thereof), apparatus are known which use detecting organs, which are positioned in a position along the path which the pharmaceutical/parapharmaceutical articles are conveyed and directed towards a container, so as to carry out the control and counting of the articles before they arrive in the zone in which they are placed in the containers.

For example, in a first known apparatus, the articles are advanced along a first horizontal vibrating conveyor such that the articles are advanced so as to distance them one from another.

An inclined second conveyor is positioned at the end of the first vibrating conveyor, which second conveyor receives, one by one, the articles coming from the first vibrating conveyor and directs the articles towards a relative container located inferiorly using the force of gravity, the articles sliding on the inclined second conveyor.

Article detecting devices are positioned in front of the inclined second conveyor, for example constituted by optic sensors which have the task of detecting the shape of the articles which transit on the second conveyor and the number of articles which pass.

On the basis of the detections carried out and the signal emitted by the detecting devices, a control unit verifies whether the signal supplied by the transited article corresponds or not to the reference signal corresponding to a whole article.

In this way it is possible to know, apart from how many articles have passed and therefore are contained in the container, whether a non-whole article, or an article corresponding to the required parameters, has been inserted.

If a non-whole article is verified, the container, with all its contents, will be rejected, independently of whether it also contains perfectly whole articles.

This Is undoubtedly a drawback.

Further, with this apparatus between the second inclined conveyor and the containers to be filled, accumulating conduits are usually positioned for the articles, before they are effectively inserted in the containers.

These conduits, arranged vertically, exhibit an upper mouth arranged in proximity of the terminal part of the second conveyor. It can therefore happen that the articles in free fall by force of gravity from the second conveyor towards the inside of the conduits strike the walls of the second conveyor and bounce backwards, newly passing below the field of action of the detecting device.

This circumstance negatively impacts on the counting of the articles. In fact, in this case, a same article can be counted twice.

An example of an apparatus of this type is described in document WO96/04171.

In another type of apparatus the articles, after having been advanced along a vibrating conveyor so that they can be separated and distanced from one another, are made to fall by gravity downwards in the direction of special product-accumulating conduits provided inferiorly of a mobile hatch door for accumulating the articles and unloading them in an underlying container.

Detecting sensors are located along the falling path (by gravity) in an intermediate position between the vibrating conveyor and the accumulating conduits, which detecting sensors detect the passage of the articles and the physical characteristics thereof, for example constituted by a capacitive sensor.

This enables counting how many articles pass and to have a signal corresponding to the shape and weight thereof; this signal then compared with the reference values in order to evaluate whether the article is more or less integral and conforming to the required parameters.

If an article is detected that is not whole, or not conforming, a blower nozzle is present with directs an air current towards the falling path of the article, which is aimed at deviating the article from its normal falling path.

An example of an apparatus of this type is described in document US2009/056825.

This apparatus however includes various drawbacks.

Firstly, the articles are dropped freely by force of gravity and therefore are subject to impacts and bouncing of the articles when they arrive in the accumulating conduits which can cause breakage or grazing thereof.

It can therefore occur that an article has been validated as whole following the passage thereof through the capacitive sensor but that it can then be subjected to impacts that can damage it; but that it can in any case be inserted in a container and the container then be put up for sale notwithstanding the presence of one or more articles that are not whole and therefore not suitable or in conformity with the required standards.

Further, there is no certainty that the draught of air, when activated, is truly effective in deviating the falling article, as the article might already have transited beyond the field of action of the jet of air.

Therefore, this apparatus too cannot be held to be reliable in obtaining the filling of the containers with pharmaceutical/parapharmaceutical articles which are perfectly counted in terms of numbers and perfectly whole as regards the physical properties thereof.

The aim of the present invention is therefore to provide a filling apparatus of containers for filling containers with pharmaceutical/parapharmaceutical articles able to obviate the various above-cited drawbacks present in the apparatus of known type.

SUMMARY OF THE INVENTION

A particular aim of the present invention is to disclose an apparatus that is able to guarantee that the articles placed in the containers are only whole ones that correspond to the required parameters, that the counting of the whole articles introduced into the containers is accurate and precise and that the articles that have been recognized as whole, and therefore which have been directed towards the containers to fill them, are preserved from any possible damage.

In this way, the containers will only be filled with whole articles, and with exactly the requested number of articles.

This aim is attained by an apparatus for filling containers with pharmaceutical/parapharmaceutical articles comprising an article transfer element, the article transfer element having an article inlet side, an article outlet side and an article sliding surface for sliding the articles from the inlet side to the outlet side. The article transfer element is arranged and inclined so as to face the article inlet side towards a vibrating conveyor, so as to receive articles therefrom that are spaced from one another and fed by the vibrating conveyor. The article outlet side faces in a direction towards a mouth of an article accumulating conduit. An outlet of the article accumulating conduit is positioned above a container to be filled, so as to direct articles that move along the sliding surface towards the mouth. A sensor (8, 9) detects characteristics of the articles and counts the articles. The sensor is associated with the article transfer element in a position between the article inlet side and the article outlet side so as to detect the characteristics of the articles which move along the sliding surface. The sensor generates a signal indicating the characteristics before the articles reach the article outlet side, the sensor providing a counter signal identifying the number of articles which pass from the inlet side to the outlet side.

A mobile element having a first curved surface and a second curved surface is arranged in a position situated in a space located between the article outlet side of the transfer element and the mouth of the accumulating conduit. The mobile element is movable with respect to the article transfer element and the mouth of the accumulating conduit, between at least a first orientation, in which the mobile element is positioned so that the first curved surface is arranged to permit a continuity in advancement of the articles which pass beyond the outlet side of the transfer element towards the mouth of the accumulating conduit, and a second orientation in which the mobile element is positioned so that the second curved surface is arranged to prevent a continuity of advancement of the articles towards the mouth of the accumulating conduit.

The first curved surface has a curvature such that, when the mobile element is positioned in the first orientation, the first curved surface forms a sliding surface for the articles which pass beyond the outlet side so as to enable a continuity of movement for the articles once they have passed beyond the outlet side, preventing a free fall thereof by force of gravity. The second curved surface has a curvature such that, when the mobile element is positioned in the second orientation, the second curved surface forms a deviating surface for deviating the articles passing beyond the outlet side so as to distance the articles far away from the outlet side. The mobile element is directed to assume the first orientation when the signal emitted by the sensor indicates a whole article and is directed to assume the second orientation when the signal emitted by the sensor indicates a non-whole or non-conforming article.

The apparatus proposed by the present invention is specifically applicable for use in automatic packing machines for packing pharmaceutical/parapharmaceutical articles into containers.

These automatic packing machines usually comprise a hopper where the articles are piled and accumulated, a series of vibrating conveyors for conveying the articles, separating them and distancing them in a line one after another, from the hopper towards the section of the machine which has the function of filling the containers.

In this section the apparatus disclosed by the present invention is used, which is installed in a location between the vibrating conveyors and a series of accumulating conduits for the articles which are arranged vertically above an advancing line of containers to be filled.

This apparatus has the function, as indicated above, of enabling only whole articles to reach the accumulating conduits in order then to be introduced in the containers, at the same time performing a counting thereof so that the exact requested number of whole articles are located in the conduits and therefore will go into the containers.

Other advantageous characteristics of the apparatus of the present invention are set out in the various dependent claims.

BRIEF DESCRIPTION OF THE DRAWINGS

The characteristics of the filling apparatus of the present invention are described in the following, described with reference to the appended tables of drawings in which.

DESCRIPTION OF THE PREFERRED EMBODIMENTS

With reference to the accompanying figures, reference number (100) denotes the filling apparatus disclosed in the present invention which, as indicated above, is especially applicable in automatic machines for packing pharmaceutical/parapharmaceutical articles into relative containers.

Figure 3:
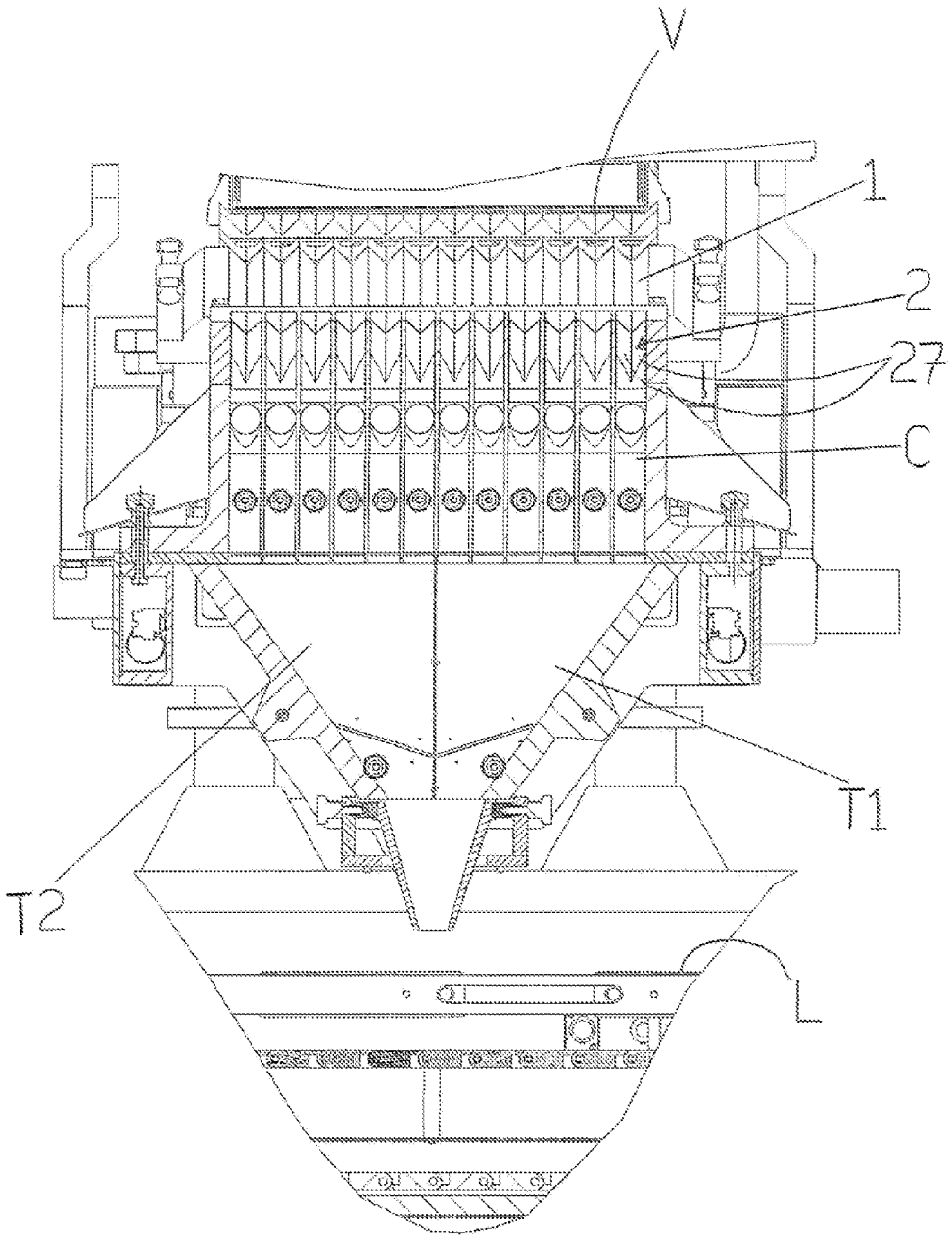
FIG. 3 is a front view of the apparatus of the invention predisposed in the automatic machine; in this figure a partial section can be observed of the machine after the accumulating conduits (C) and the advancement line (L) of the containers to be filled.

The apparatus (100) is installed and assembled, as illustrated in the figures, in the passage zone of the articles from the vibrating conveyors (V) to the accumulation conduits (C) which are arranged above a double hopper (T1, T2) provided with hatches for unloading and introducing the articles into containers that are advanced along an advancing line (L) (see for example FIG. 3).

The vibrating conveyors (V) receive the articles from a hopper or magazine where the articles are stacked and stored; the task of the vibrating conveyors (V) is to advance the articles towards the zones of the machine set aside for inserting the articles into relative containers in such a way as to distance them one from another.

The filling apparatus (100) of the invention comprises an article transfer element (1) exhibiting an article inlet side (11) and an article outlet side (12) and an article sliding surface (13) for sliding the articles from the inlet side (11) to the outlet side (12).

The article transfer element (1) is arranged inclined so as to face the article inlet side (11) at a vibrating conveyor (V) of the automatic machine in order to receive articles that are spaced from one another coming from the vibrating conveyor (V) and in such a way as to face the article outlet side (12) in the direction of a mouth (I) of an article accumulating conduit (C), the outlet of which is positioned above a container to be filled, so as to direct the articles that move along the sliding surface (13) towards the mouth (1).

Figure 1:
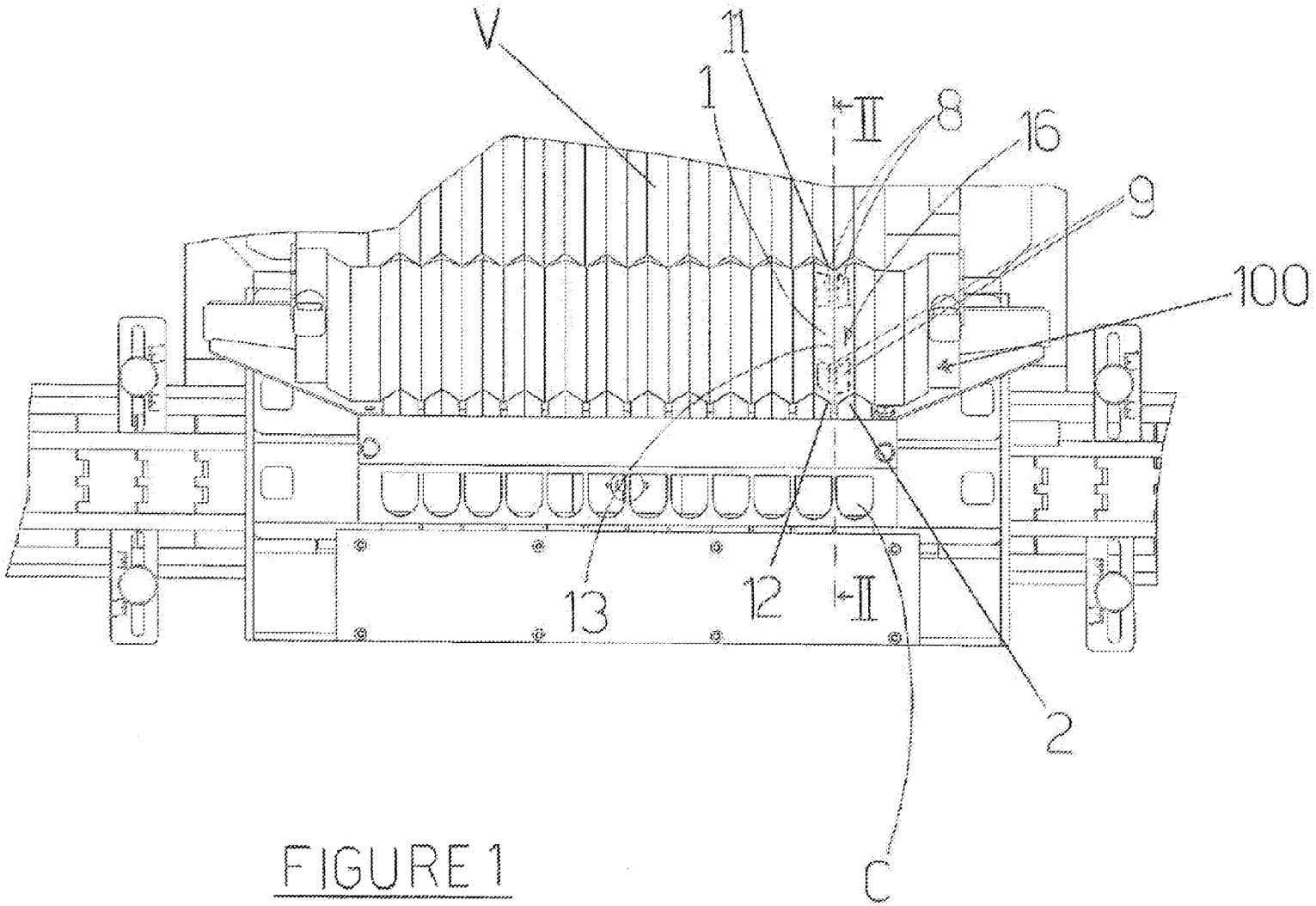
FIG. 1 is a view from above of a preferred but not exclusive embodiment of the filling apparatus of the invention, mounted and installed in an automatic machine for packing pharmaceutical/parapharmaceutical articles, in a position interposed between the end of a vibrating conveyor (V) and a series of accumulating conduits (C) of the articles to be inserted in the containers.
Figure 2A:
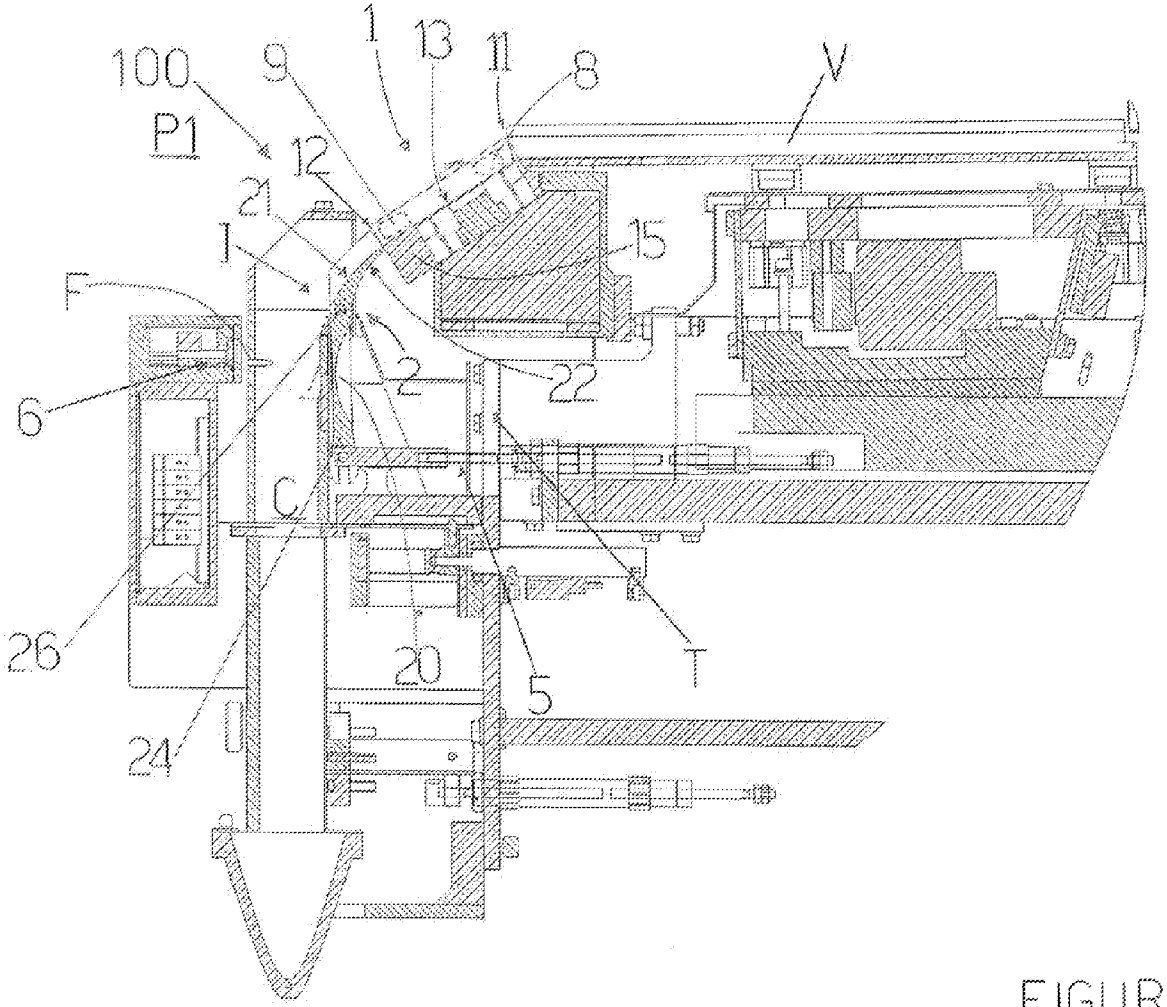
FIGS. 2A and 2B are larger scale illustrations, the view taken along section II-II of FIG. 1 with the apparatus in two distinct operating configurations, respectively, of passage of the articles recognized as whole towards the accumulating conduits, and of deviation towards rejection conduits for those articles recognized as not whole and therefore not suitable for being inserted in the containers.

The apparatus (100) further comprises one or more sensors (8, 9) for detecting characteristics of the articles and for counting the articles, visible for example in a broken line in FIG. 1 and in FIGS. 2A, 28, which are associated to the transfer element (1) in at least a position between the article inlet side (11) and the article outlet side (12).

The sensor (8. 9) is provided for detecting the characteristics of the articles which move along the sliding surface (13) and provide a signal indicating the characteristics (whole article, not-whole article) before the articles reach the article outlet side (12) and to provide a counter signal of the number of articles which pass from the inlet side (11) to the outlet side (12).

A particular characteristic of the apparatus (100) of the present invention is that it includes a mobile element (2) having a first curved surface (21) and a second curved surface (22), and which is arranged, when the apparatus (100) is installed in the automatic machine, in a position situated in a space located between the article outlet side (12) of the transfer element (1) and the mouth (I) of the accumulating conduit (C).

The mobile element (2) is commandable so to assume, with respect to the article transfer element (1) and to the mouth (I) of the accumulating conduit (C), at least at least a first orientation (P1), in which the mobile element (2) is positioned such that the first curved surface (21) is arranged to enable a continuity in advancement of the articles which pass beyond the outlet side (12) of the transfer element (1) towards the mouth (I) of the accumulating conduit (C) (see FIG. 2A), and a second orientation (P2), in which the mobile element (2) is positioned such that the second curved surface (22) is arranged to prevent a continuity of advancement towards the mouth (I) of the accumulating conduit (C) of the articles which pass beyond the outlet side (12) of the transfer element (1) (see FIG. 28).

A further special characteristic of the apparatus (100) is constituted by the fact that the first curved surface (21) exhibits a curvature that is such that, when the mobile element (2) is positioned in the first orientation (P1), the first curved surface forms a sliding surface for the articles which pass beyond the outlet side (12) so as to enable a continuity of movement for the articles once they have passed beyond the outlet side (12), preventing a free fall thereof by force of gravity and in that the second curved surface (22) has a curvature such that, when the mobile element (2) is positioned in the second orientation (P2), the second curved surface forms a deviating surface for the articles passing beyond the outlet side (12) so as to deviate and distance the articles away from the outlet side (12).

The apparatus (100) is predisposed and programmed such that the mobile element (2) is commanded to assume the first orientation (P1) when the signal emitted by the sensor (8, 9) indicates a whole article and is commanded to assume the second orientation (P2) when the signal emitted by the sensor (8, 9) indicates a non-whole article.

In this way, in the case where the article received from the transfer element (1) is recognized as whole by the sensor (8, 9) during the sliding thereof on the sliding surface (13) towards the outlet side (12), the mobile element (2) is commanded to assume the first orientation (P1) (FIG. 2A) and the whole article can continue its sliding path continuously as the first curved surface (21) of the mobile element (2) enables the article to slide, preventing it from having a free fall by force of gravity.

The mobile element (2), in the first orientation (P1) with the curved surface (21) thereof, then accompanies the whole article from the outlet side (12) of the transfer element (1) up to the mouth (I) of the accumulating channel (C), limiting and reducing to a minimum the entirety of the free fall travel of the article, thus preventing the article recognized as being whole from being subjected to significant impacts which might damage it during the insertion thereof in the accumulating conduit (C).

On the other hand, in a case in which the article received from the transfer element (1) is recognized as not being whole by the sensor (8, 9) during the sliding thereof on the sliding surface (13) towards the outlet side (12), the mobile element (2) is commanded to take on the second orientation (P2) (FIG. 2B) and the non-whole article once having passed beyond the outlet side (12) cannot continue the advancement thereof towards the mouth (I) as the second curved surface (22) is arranged in the advancement path thereof and the second curved surface (22) exhibits a curvature which deviates the non-whole article for a distant from the outlet side (12), such that there is no possibility that this non-whole article can return into the field of action of the sensor (8, 9) associated to the transfer element (1).

The sensor (8, 9) is further able to count the number of articles sliding from the inlet side (11) to the outlet side (12) of the transfer element (1). In this way, it is possible to know with certainty how many articles recognized as whole have been directed into the accumulating conduit (C) and thus consequently how many articles will be placed into the underlying containers.

Other and further characteristics of the apparatus (100) are set out in the following.

The apparatus (100) has a support frame (T) for supporting the mobile element (2) and the transfer element (1), the mobile element (2) being rotatably constrained to the frame (T). The apparatus (100) further has an actuator organ (5) for moving the mobile element (2) in order to position the mobile element (2) into the first orientation (P1), when the signal emitted by the sensor (8, 9) is indicative of a whole article, and for positioning the mobile element (2) in the second orientation (P2), when the signal emitted by the sensor (8, 9) is indicative of a non-whole article.

The actuator organ (5) can be constituted by a hydraulic or pneumatic piston, or a further activating organ.

In particular, the transfer element (1) is borne by the frame (T) in such a way as to be inclined, with respect to a horizontal plane, by an angle comprised between 30° and 45°, and more specifically and in particular advantageously so as to be inclined by an angle of 40°.

The applicant has observed that this 40° inclination of the transfer element (1) with respect to a horizontal plane, i.e. the inclination of the sliding surface (13) along which the articles slide, is the best one as on the one hand the influence the mass of the articles has on the linear velocity with which the articles slide along the sliding surface (13) is reduced, while on the other hand the crossing time taken by the articles to transit across the field of action of the sensor (8, 9) enables the sensor (8, 9) to carry out the required detecting operations.

In more detail, the applicant has found that with the 40° inclination of the sliding surface (13) of the transfer element (1) with respect to a horizontal plane, the articles which exhibit a mass, and therefore a weight, even different from one another, for example a full tablet and a half tablet, tend to maintain a same reciprocal distance during the sliding thereof from the inlet side (11) to the outlet side (12).

With different inclinations. for example of less than 30°, the articles having a lower weight (half-tablets) tended to slow down too much and were caught up by heavier articles (full tablets), which circumstance considerably Influences the ability of the sensor (8, 9) to work accurately.

In fact, in this case, the two articles would pass by the sensor (8, 9) too close to one another and the signal provided by the sensor would not be suitable for recognizing either one or the other of the two articles as they would be too close.

The applicant has also found that by inclinations of greater than 40° of the transfer element (1) with respect to a horizontal plane, the crossing time of the articles at the sensor (8, 9) would be so low as not to enable the sensor (8, 9) to make a correct detection.

The mobile element (2) is constructed in such a way that the first curved surface (21) exhibits a curvature which is such that when the mobile element (2) is positioned in the first orientation (P1) the first curved surface (21) connects with the outlet side (12) of the transfer element (1) so as to constitute, for the articles which pass beyond the outlet side (12) (i.e. for the articles which has been recognized as whole). a continuous sliding surface with the sliding surface (13) of the articles along the transfer element (1). so as to direct the articles towards the mouth (I) of the accumulating conduit (C) preventing a free fall thereof by force of gravity.

In particular, the applicant has observed that the optimal curvature for the curvature of the first curved surface (21) of the mobile element (2) must have a parabolic branch progression; this parabolic branch is calculated on the basis of the inclination with respect to a horizontal plane of the sliding surface (13) of the transfer element (1) in such a way that the progression of the parabolic branch exhibits a trajectory similar to that which the articles passing beyond the outlet side (12) of the transfer element, would have if it were in free fall.

In practice, the curvature of the first curved surface (21) is selected in such a way as to reproduce the trajectory that the articles would have if in free fall: in this way the articles can slide along the first curved surface (21) of the mobile element (2) without being subjected to deviations and while passing along it are also slowed down with respect to when in free fall.

This means that the articles recognized as whole articles are accompanied without jags and are piloted and in some measure slowed down within the mouth (I) of the accumulating conduit (C), reducing the risk of any damage thereto.

The transfer element (1) is constituted by a support (15) which comprises at least a sliding channel (16) for articles which exhibits two V-shaped lateral converging walls.

The sensor (8, 9) for detecting the characteristics of the articles and the counting is constituted by at least one capacitive sensor (8, 9) provided with two armatures positioned in at least a position between the inlet side (11) and the outlet side (12) of the transfer element (1).

The capacitive sensor (8, 9) is positioned with respect to the transfer element (1) in such a way that a first armature is associated and parallel to a first V-shaped lateral wall of the sliding channel (16) and a second armature is associated and parallel to a second V-shaped lateral wall of the sliding channel (16).

In more detail, for example in the preferred but not exclusive embodiment of the apparatus illustrated in the figures, the sensor (8, 9) comprises a first capacitive sensor (8) and a second capacitive sensor (9) each of which is provided with two armatures.

Figure 2B:
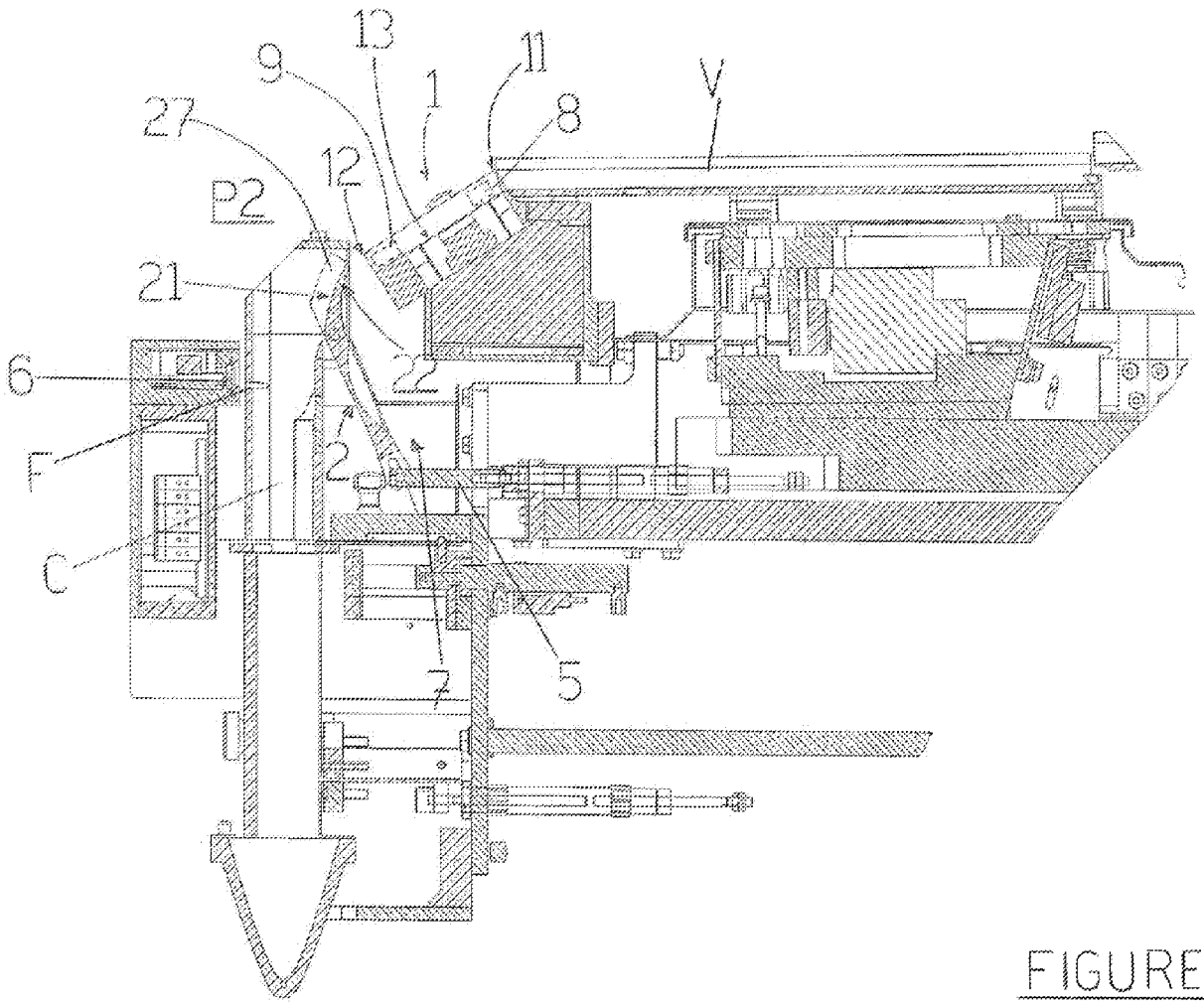

The first capacitive sensor (8) is positioned in a first position between the inlet side (11) and the outlet side (12) of the transfer element (1) while the second capacitive sensor (9) is positioned in a second position between the inlet side (11) and the outlet side (12) of the transfer element (1) downstream of the first capacitive sensor (8) (see for example FIGS. 1, 2A, 2B where these capacitive sensors are represented schematically with a broken line).

The two capacitive sensors (8, 9) are positioned such that a first armature of the first capacitive sensor (8) and a first armature of the second capacitive sensor (9) are associated and parallel to a first lateral wall of the V-shaped channel (16) and in such a way that a second armature of the first capacitive sensor (8) and a second armature of the second capacitive sensor (9) are associated to and parallel to a second lateral wall of the V-shaped channel (16).

The sensor further comprises a first RC electronic oscillator circuit (not illustrated), of which, as a detecting component, the first capacitive sensor (8) is a part, and a second RC electronic oscillator circuit of which, as a detecting component, the second capacitive sensor (9) is part.

The first electronic oscillator circuit is connected to a first reference potential and the first capacitive sensor (8) is inserted as a component of the first electronic oscillator circuit in such a way that the relative first armature, i.e. the armature parallel to the first lateral wall of the V-shaped channel (16), is connected to the first reference potential.

The second electronic oscillator circuit, on the other hand, is connected to a second reference potential and the second capacitive sensor (9) is inserted as a component of the second electronic oscillator circuit in such a way that the relative second armature, i.e. the armature parallel to the second lateral wall of the V-shaped channel (16), is connected to the second reference potential.

This particular arrangement and connection of the armature of the two capacitive sensors at the relative reference potentials enables a greater detecting quality of the characteristics of the articles transiting between the capacitive sensors and thus a better ability to identify and validate the articles independently of the orientation that they can assume during the sliding thereof along the V-shaped sliding channel (16), from the inlet side (11) to the outlet side (12) of the transfer element (1).

The mobile element (2) is constituted by a support (20) which comprises a first part (24) that is connected to the actuator organ (5), a second part (25) that has a shape and a dimension such as to comprise, on a side, the first curved surface (21) and, on the other side, the second curved surface (22), and a third part (26), comprised between the first part (24) and the second part (25), with which the support (20) is constrained rotatably to the frame (T).

The second part (25) of the support (20), the part provided with the first curved surface (21) and the second curved surface (22), is provided with at least a pair of walls (27) converging in a V-shape which are arranged on the first curved surface (21) in such a way as to be arranged consecutively to the two lateral V-shaped walls of the at least a channel (16) present on the transfer element (1), when the mobile element (2) is positioned in the first orientation (P1).

The converging walls (27) constitute lateral containing walls for the articles recognized as whole during the sliding thereof on the first curved surface (21) of the mobile element (2) towards the mouth (I).

The apparatus (100) further comprises at least an optical sensor (6) for detecting a passage of articles, which is positioned at a slit (F) present on the lateral wall of the accumulating conduit (C), inferiorly of the mouth (1), in such a way as to emit a light beam which crosses the conduit (C) in order to detect the transit of an article.

With the presence of this optical sensor (6) the apparatus is able to carry out a further safety test to verify that effectively an article that had been recognized as not whole by the sensor (8, 9) during the sliding of the article along the sliding surface of the transfer element (1), and therefore not suitable to be placed in a container, has actually been deviated by the mobile element (2).

In fact, in a normal functioning situation, in a case in which the sensor (8,9) detect passage of a non-whole article, the mobile element (2) is commanded into the second orientation (P2) so as to deviate the article, preventing it from continuing in its advancement path towards the mouth (I) of the accumulating conduit (C), and then preventing the non-whole article from finishing in the accumulating conduit (C).

In this circumstance the optic sensor (6) specially positioned so as to emit an optical beam that crosses the conduit will not have to detect any passage of an article. Therefore the absence of a signal emission by the optical sensor will confirm that the deviation of the non-whole article has effectively been carried out.

In a contrary case, i.e. where notwithstanding the detecting of a non-whole article by the sensor (8, 9), the optical sensor (6) detected the transit, i.e. the fall, of an article into the accumulating conduit (C), this would indicate that for some reason or drawback a non-whole article had finished up in the accumulating conduit (C).

This would enable proceeding to reject the container in which the non-whole article had managed to be packed.

The optical sensor (6) will also supply a verification of the effective number of whole articles directed by the mobile element (2) into the mouth (I) of the accumulating conduit (C).

With the aim of coordinating and controlling all the above-described operations, the apparatus (100) is provided with an electronic control unit connected to a sensor (8, 9), to the optical sensor (6) and the actuator organ (5) provided for commanding the actuator organ (5) and moving the mobile element (2) in response to the type of signal received from the sensor (8, 9) indicating the wholeness or non-wholeness of the articles passing along the transfer element (1) and supplying a signal that is indicative of how many whole articles have been directed to and placed in the accumulating conduit (C).

The apparatus (100) of the present invention is also designed and constructed such that the transfer element (1) comprises a number of channels (16) having V-shaped walls in a number corresponding to the number of article accumulating conduits (C) which are present in the automatic packing machine of the pharmaceutical/parapharmaceutical articles and the second part (25) of the mobile element (2) comprises a number of pairs of converging V-shaped walls (27) in a number corresponding to the number of accumulating conduits (C).

For example, as illustrated in FIG. 3, in a case in which the automatic packing machine of pharmaceutical/parapharmaceutical articles comprises twelve accumulating conduits (C), before they are placed in relative containers, the transfer element (1) will be constructed in such a way that the relative support element (20) is provided with twelve channels (16) with lateral walls converging in a V-shape, just as the second part (25) of the mobile element (25) is provided with twelve pairs of V-shaped converging walls (27).

As illustrated in FIG. 3, the machine will be equipped with a double-hopper (T1, T2) for collecting the whole articles, each of which will be able to collect the whole articles coming from six accumulating conduits, then to send them into relative containers that will transit below when advanced by the line (L).

Lastly, as can be seen in FIGS. 2A, 2B, the apparatus (100) comprises an unloading conduit (7) for the non-whole articles, which is supported by the frame (T) and which is situated below the outlet side (12) of the transfer element (1).

In this regard, the second curved surface (22) of the mobile element (2) exhibits a curvature that is such that when the mobile element (2) is positioned in the second orientation (P2), the articles, for which a signal has been emitted by the sensor (8, 9), indicating that these articles are not whole, once having passed beyond the outlet side (12) of the transfer element (1) and having arrived in contact with the second curved surface (22), are deviated from the second curved surface (22) in a downwards direction, into the direction of the unloading channel (7).

A recipient (not illustrated) will be present at the end of the unloading conduit (7) in which the non-whole articles will be collected.

The apparatus disclosed by the present invention, differently to apparatus of the known art described herein above, is therefore able to guarantee that the articles placed internally of the containers are only entire articles corresponding to the required parameters, that the counting of the whole articles placed in the containers is accurate and precise and that the articles recognized as whole, and thus directed towards the containers such as to fill them are safeguarded from any possible damage.

In this way, the containers will be filled only by whole articles and exactly with the required number of articles The above has been described by way of non-limiting example, and any eventual constructional variants are understood to fall within the scope of the following claims.

I claim:

1. An apparatus for filling containers with pharmaceutical/parapharmaceutical articles comprising:

an article transfer element (1), the article transfer element (1) having an article inlet side (11), an article outlet side (12) and an article sliding surface (13) for sliding the articles from the inlet side (11) to the outlet side (12), the article transfer element (1) being arranged and inclined so as to face the article inlet side (11) towards a vibrating conveyor (V), so as to receive articles therefrom that are spaced from one another and fed by said vibrating conveyor (V), the article outlet side (12) facing in a direction towards a mouth (I) of a article accumulating conduit (C), an outlet of the article accumulating conduit positioned above a container to be filled, so as to direct articles that move along the sliding surface (13) towards the mouth (I), a sensor (8, 9) for detecting characteristics of the articles and for counting the articles, which is associated with the article transfer element (1) in a position between the article inlet side (11) and the article outlet side (12) so as to detect the characteristics of the articles which move along the sliding surface (13), the sensor generating a signal indicating the characteristics before the articles reach the article outlet side (12), the sensor providing a counter signal identifying the number of articles which pass from the inlet side (11) to the outlet side (12);

a mobile element (2) having a first curved surface (21) and a second curved surface (22), the mobile element (2) being arranged in a position situated in a space located between the article outlet side (12) of the transfer element (1) and the mouth (I) of the accumulating conduit (C), the mobile element (2) being movable, with respect to the article transfer element and the mouth (I) of the accumulating conduit (C), between at least a first orientation (P1), in which the mobile element (2) is positioned so that the first curved surface (21) is arranged to permit a continuity in advancement of the articles which pass beyond the outlet side (12) of the transfer element (1) towards the mouth (I) of the accumulating conduit (C), and a second orientation (P2), in which the mobile element (2) is positioned so that the second curved surface (22) is arranged to prevent a continuity of advancement of the articles towards the mouth (I) of the accumulating conduit (C), and, wherein the first curved surface (21) has a curvature such that, when the mobile element (2) is positioned in the first orientation (P1), the first curved surface forms a sliding surface for the articles which pass beyond the outlet side (12) so as to enable a continuity of movement for the articles once they have passed beyond the outlet side (12), preventing a free fall thereof by force of gravity, and, wherein the second curved surface (22) has a curvature such that, when the mobile element (2) is positioned in the second orientation (P2), the second curved surface forms a deviating surface for deviating the articles passing beyond the outlet side (12) so as to distance the articles away from the outlet side (12), and, wherein the mobile element (2) is directed to assume the first orientation (P1) when the signal emitted by the sensor (8, 9) indicates a whole article and is directed to assume the second orientation (P2) when the signal emitted by the sensor (8, 9) indicates a non whole or non conforming article.

2. The apparatus of claim 1, further comprising a support frame (T) for supporting the mobile element (2) and the transfer element (1), the mobile element (2) being rotatably constrained to the frame (T); and, an actuator organ (5) for moving the mobile element (2) in order to position the mobile element (2) into the first orientation (P1), when the signal emitted by the sensor (8, 9) is indicative of a whole article, and for positioning the mobile element (2) in the second orientation (P2), when the signal emitted by the sensor (8, 9) is indicative of a non-whole article.

3. The apparatus of claim 2, wherein the transfer element (1) is borne by the frame (T) in such a way as to be inclined, with respect to a horizontal plane, by an angle comprised between 30° and 45°.

4. The apparatus of claim 3, wherein the curvature of the first curved surface (21) of the mobile element (2) exhibits a parabolic branch progression, with the parabolic branch progression being calculated based on the inclination with respect to a horizontal plane of the sliding surface (13) of the transfer element (1), such that the progression of the parabolic branch exhibits a trajectory that is alike to a trajectory that the articles passing beyond the outlet side (12) of the transfer element would have if they were in free fall.

5. The apparatus of claim 3, wherein the transfer element (1) is constituted by a support (15) which comprises at least a sliding channel (16) for articles which exhibits two V-shaped lateral converging walls and wherein the sensor (8, 9) is at least one capacitive sensor (8, 9) provided with two armatures positioned in at least a position between the inlet side (11) and the outlet side (12) of the transfer element (1), with a first armature of the capacitive sensor associated and parallel to a first lateral wall of the V-shaped channel (16) and a second armature of the capacitive sensor associated and parallel to a second lateral wall of the V-shaped channel (16).

6. The apparatus of claim 5, wherein the sensor (8, 9) comprises a first capacitive sensor (8) and a second capacitive sensor (9), each of which is provided with two armatures, the first capacitive sensor (8) being positioned in a first position between the inlet side (11) and the outlet side (12) of the transfer element (1) and the second capacitive sensor (9) being positioned in a second position between the inlet side (11) and the outlet side (12) of the transfer element (1) downstream of the first capacitive sensor (8), with a first armature of the first capacitive sensor (8) and a first armature of the second capacitive sensor (9) being associated and parallel to a first lateral wall of the V-shaped channel (16) and with a second armature of the first capacitive sensor (8) and with a second armature of the second capacitive sensor (9) being associated and parallel to a second lateral wall of the V-shaped channel (16), and further comprising a first RC electronic oscillator circuit for forming a detecting component for the first capacitive sensor (8), and a second RC electronic oscillator circuit for forming a detecting component for the second capacitive sensor (9), wherein the first RC electronic oscillator circuit is connected to a first reference potential and the first capacitive sensor (8) is inserted as a component of the first electronic oscillator circuit in such a way that the first armature which is parallel to the first lateral wall of the V-shaped channel (16), is connected to the first reference potential, and the second RC electronic oscillator circuit is connected to a second reference potential and the second capacitive sensor (9) is inserted as a component of the second electronic oscillator circuit in such a way that the second armature which is parallel to the second lateral wall of the V-shaped channel (16), is connected to the second reference potential.

7. The apparatus of claim 5, wherein the mobile element (2) is constituted by a support (20) which has a first part (24) that is connected to the actuator organ (5), a second part (25) that has, on a side thereof, the first curved surface (21) and, on another side thereof, the second curved surface (22), and a third part (26), comprised between the first part (24) and the second part (25), with which the support (20) is constrained rotatably to the frame (T), and wherein the second part (25) is provided with at least a pair of walls (27) converging in a V-shape which are arranged on the first curved surface (21) in such a way as to be arranged consecutively to the two lateral V-shaped walls of at least one channel (16) present on the transfer element (1), when the mobile element (2) is positioned in the first orientation (P1).

8. The apparatus of claim 5, wherein the transfer element (1) comprises a number of channels (16) having V-shaped walls in a number corresponding to the number of article accumulating conduits (C) and the second part (25) of the mobile element (2) comprises a number of pairs of converging V-shaped walls (27) in a number corresponding to the number of accumulating conduits (C).

9. The apparatus of claim 2 wherein the transfer element (1) is borne by the frame (T) in such a way as to be inclined, with respect to a horizontal plane, by an angle of 40°.

10. The apparatus of claim 2, further comprising an unloading conduit (7) for removing the non-whole articles, the unloading conduit supported by the frame (T) and situated inferiorly at the outlet side (12) of the transfer element (1), and wherein the second curved surface (22) has a curvature such that, when the mobile element (2) is positioned in the second orientation (P2), the non-whole articles, once having passed beyond the outlet side (12) of the transfer element (1) and having reached contact with the second curved surface (22), are deviated by the second curved surface (22) downwards in a direction towards the unloading conduit (7).

11. The apparatus of claim 1, further comprising at least one optical sensor (6) for detecting a passage of articles, which is positioned at a slit (F) present on a lateral wall of the accumulating conduit (C), inferiorly of the mouth (1), so as to emit a light beam which crosses the conduit (C) in order to detect the transit of an article.

12. The apparatus of claim 11 further comprising an electronic control unit connected to the sensor (8, 9), to the optical sensor (6) and to the actuator organ (5), for commanding the actuator organ (5) and moving the mobile element (2) depending on the signal received from the sensor (8, 9) indicating the wholeness or non-wholeness of the articles passing along the transfer element (1) and supplying a signal that is indicative of how many whole articles have been directed to and placed in the accumulating conduit (C).

* * * * *